US012342851B2

(12) United States Patent
Mishra et al.

(10) Patent No.: US 12,342,851 B2
(45) Date of Patent: Jul. 1, 2025

(54) SMOKING ARTICLE WITH REDUCED TOBACCO

(71) Applicant: Altria Client Services LLC, Richmond, VA (US)

(72) Inventors: Munmaya K. Mishra, Richmond, VA (US); Shaoyong Yu, Richmond, VA (US); Weiling Li, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 436 days.

(21) Appl. No.: 15/835,743

(22) Filed: Dec. 8, 2017

(65) Prior Publication Data

US 2019/0174814 A1 Jun. 13, 2019

(51) Int. Cl.

| | |
|---|---|
| ***A24D 1/00*** | (2020.01) |
| ***A24B 15/16*** | (2020.01) |
| ***A24D 3/06*** | (2006.01) |

(52) U.S. Cl.

CPC ..... *A24D 1/002* (2013.01); *A24B 15/16* (2013.01); *A24D 3/061* (2013.01)

(58) Field of Classification Search

CPC ..... A24D 1/002; A24D 3/061
USPC ..... 131/274
See application file for complete search history.

(56) References Cited

U.S. PATENT DOCUMENTS

| | | | | |
|---|---|---|---|---|
| 12,417 A * | 2/1855 | Goshon | A24B 15/28 | 131/309 |
| 2,360,628 A * | 10/1944 | Wright | A24F 1/08 | 131/225 |
| 2,930,720 A * | 3/1960 | Finberg | A24B 15/16 | 131/359 |
| 3,034,931 A | 5/1962 | Kiefer | | |
| 3,106,209 A | 10/1963 | Torigian | | |
| 3,369,551 A | 2/1968 | Carroll | | |
| 3,527,235 A * | 9/1970 | Fidelman | A24D 3/045 | 55/501 |
| 3,545,448 A | 12/1970 | Forrester et al. | | |
| 3,556,109 A | 1/1971 | Briskin et al. | | |
| 3,556,110 A | 1/1971 | Briskin | | |
| 3,575,177 A | 4/1971 | Briskin et al. | | |
| 3,638,660 A | 2/1972 | Davis | | |
| 3,703,177 A | 11/1972 | Hind et al. | | |
| 3,782,391 A * | 1/1974 | Means | A24B 15/301 | 131/276 |
| 3,807,414 A | 4/1974 | Hedge | | |
| 3,861,401 A | 1/1975 | Briskin et al. | | |

(Continued)

OTHER PUBLICATIONS

MF Mcneal. Bright Tobacco Extract Specification. 1950. Lorillard Records; Master Settlement Agreement. Unknown. https://www.industrydocuments.ucsf.edu/docs/jnmy0166 (Year: 1950).*

(Continued)

*Primary Examiner* — Michael J Felton

(57) ABSTRACT

An example smoking article includes a smoking rod filled with a filler material. The filler material includes tobacco material and non-tobacco leaf material, and the filler material is distributed along a length of the smoking rod. In certain examples the tobacco material, non-tobacco leaf material, or both may be treated with one or more additives, and in other examples the filler material may not include additives. The smoking article can be formed as a cigarette, cigarillo, or cigar.

20 Claims, 6 Drawing Sheets

(56) References Cited

U.S. PATENT DOCUMENTS 3,867,951 A 2/1975 Buchmann et al.
3,878,850 A 4/1975 Gibson et al.
3,902,504 A 9/1975 Owens, Jr. et al.
3,931,824 A 1/1976 Miano et al.
3,943,940 A 3/1976 Minami
3,943,941 A 3/1976 Boyd et al.
3,951,155 A 4/1976 Prouse et al.
3,987,791 A 10/1976 Chitlenden et al.
3,993,082 A 11/1976 Martin et al.
4,014,349 A 3/1977 Morman et al.
4,019,521 A 4/1977 Briskin
4,044,777 A 8/1977 Boyd et al.
4,079,742 A 3/1978 Rainer et al.
4,119,104 A 10/1978 Roth
4,253,508 A * 3/1981 Bodai ..... A24D 3/045 131/202
4,296,762 A 10/1981 Eicher et al.
4,333,484 A 6/1982 Keritsis
4,506,684 A 3/1985 Keritsis
4,719,929 A 1/1988 Breckwoldt
4,881,555 A * 11/1989 Bolt ..... A24D 3/048 131/335
4,942,888 A 7/1990 Montoya et al.
5,018,541 A 5/1991 Hukamachi
5,046,514 A 9/1991 Bolt
5,119,836 A 6/1992 White
5,135,010 A 8/1992 Fan
5,322,075 A 6/1994 Deevi et al.
5,497,792 A 3/1996 Prasad et al.
5,513,663 A 5/1996 Van Leuven et al.
5,591,368 A 1/1997 Fleischhauer et al.
5,666,976 A * 9/1997 Adams ..... A24D 1/20 131/194
5,934,289 A 8/1999 Watkins et al.
5,996,589 A 12/1999 St. Charles
6,041,789 A 3/2000 Bankert et al.
6,053,176 A 4/2000 Adams et al.
6,083,176 A 7/2000 Terwilliger
6,257,243 B1 7/2001 Muller et al.
7,428,905 B2 9/2008 Mua
7,578,298 B2 8/2009 Karles et al.
7,578,299 B2 * 8/2009 Ra ..... A24B 15/16 131/300
7,836,896 B2 11/2010 Nadimi et al.
8,047,209 B2 11/2011 May, Jr.
8,235,056 B2 8/2012 Zhuang et al.
8,240,315 B2 8/2012 Olegario et al.
8,282,739 B2 10/2012 Mishra et al.
8,469,038 B2 6/2013 Sinlair, Jr.
8,573,230 B2 11/2013 Zhuang et al.
8,671,951 B2 3/2014 Ercelebi et al.
8,813,760 B2 8/2014 May, Jr.
8,905,037 B2 12/2014 Lipowicz et al.
9,022,041 B2 5/2015 Masri
9,066,541 B2 6/2015 Allen et al.
9,185,935 B2 11/2015 Lewis et al.
9,370,160 B2 * 6/2016 Xu ..... C12N 9/0073
2004/0094170 A1 5/2004 Zho et al.
2005/0279373 A1 12/2005 Prakash et al.
2006/0112965 A1 6/2006 Whalen
2006/0144411 A1 * 7/2006 Mercati ..... A24B 15/243 131/290
2008/0017208 A1 1/2008 Teruel
2009/0014020 A1 1/2009 Yoss et al.
2010/0288292 A1 * 11/2010 Kaljura ..... A24C 5/54 131/70
2011/0259352 A1 10/2011 Woodcock et al.
2012/0037172 A1 * 2/2012 Allen ..... A24D 3/061 131/275
2014/0202478 A1 7/2014 Awty et al.
2014/0216481 A1 8/2014 Freeman
2016/0143348 A1 * 5/2016 Camus ..... A24D 1/002 131/329
2016/0205996 A1 7/2016 John et al.
2016/0278428 A1 9/2016 Aldridge et al.
2016/0374387 A1 12/2016 Adams et al.

OTHER PUBLICATIONS

Gilbert. Patent Review: Data and Examples from Patents—Fuels. Unknown. British American Tobacco Records. Unknown. https://www.industrydocuments.ucsf.edu/docs/lhpw0208 (Year: 1997).*

Thompson, Dennis, "'Low-Nicotine' Cigarettes May Help Smokers Quit", 2015, WebMD, https://www.webmd.com/smoking-cessation/news/20150930/low-nicotine-cigarettes-may-help-smokers-quit#1 (Year: 2015).*

Cuenot-A. Tobacco Substitutes. Dec. 9, 1968. American Tobacco Records; Master Settlement Agreement. https://www.industrydocuments.ucsf.edu/docs/tnjg0017 (Year: 1968).*

* cited by examiner

SMOKING ARTICLE WITH REDUCED TOBACCO

FIELD

The present disclosure is related to a smoking article, and particularly a smoking article having a filler comprising tobacco and a non-tobacco leaf material.

SUMMARY

An example smoking article is disclosed, comprising: a smoking rod including a filler material including tobacco material and non-tobacco leaf material, wherein the filler material is distributed along a length of the smoking rod.

An example smoking article is disclosed, comprising: a smoking rod including a filler material including modified tobacco material and non-tobacco leaf material, wherein the filler material is distributed along a length of the smoking rod.

Certain embodiments may release less smoke from tobacco during combustion, and therefore a lower amount of chemicals included in smoke from tobacco, compared to a smoking article with a smoking rod that only includes tobacco.

BRIEF DESCRIPTION OF THE DRAWING FIGURES

Various aspects are further described in the detailed description which follows, in reference to the noted plurality of drawings by way of nonlimiting examples of embodiments, in which like reference numerals represent the same or similar components.

FIG. 1*a* illustrates a smoking article in accordance with an embodiment of the present disclosure;

FIG. 1*b* illustrates a smoking article in accordance with an embodiment of the present disclosure;

FIG. 1*c* illustrates an exploded view of a smoking article in accordance with an embodiment of the present disclosure;

FIGS. 2*a*-2*c* illustrate an interface filled with an additive in accordance with an embodiment of the present disclosure;

Figure 7A:
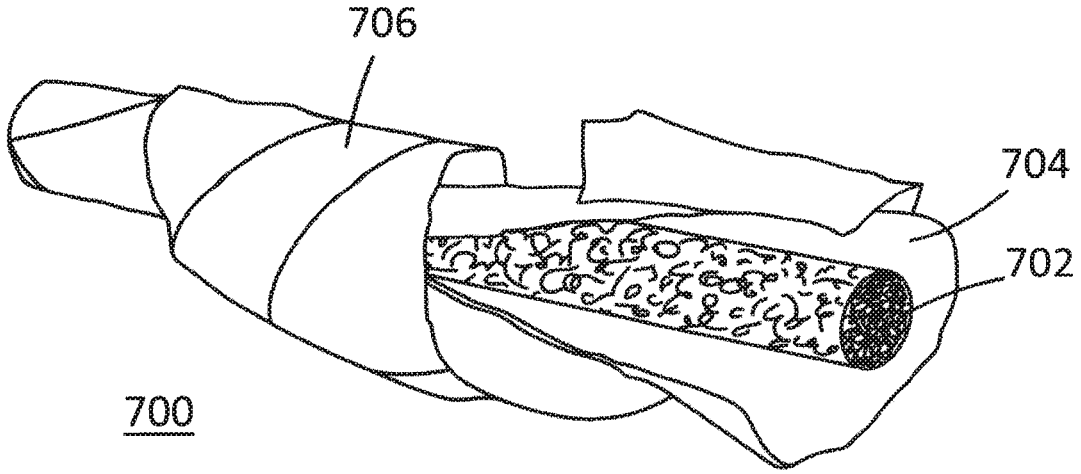
Figure 7B:
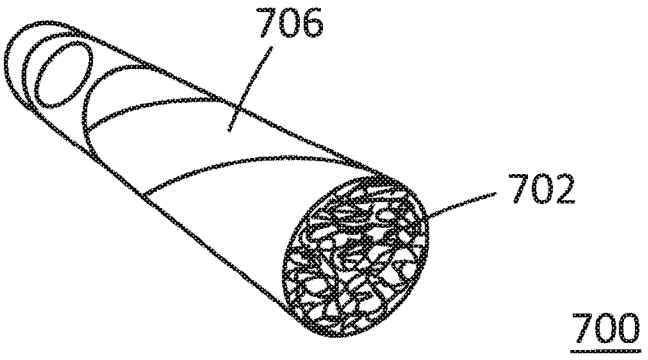
Figure 8A:
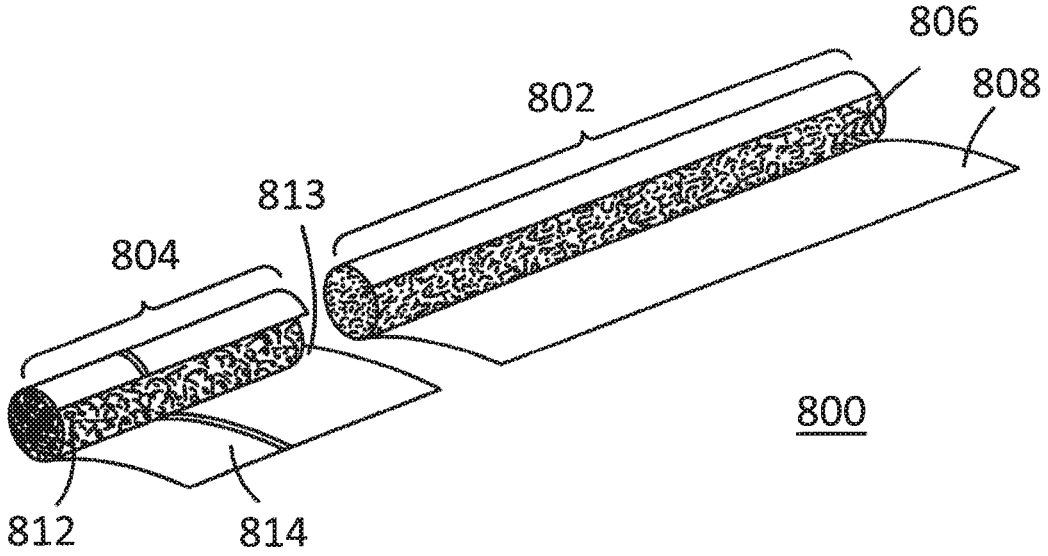
Figure 8B:
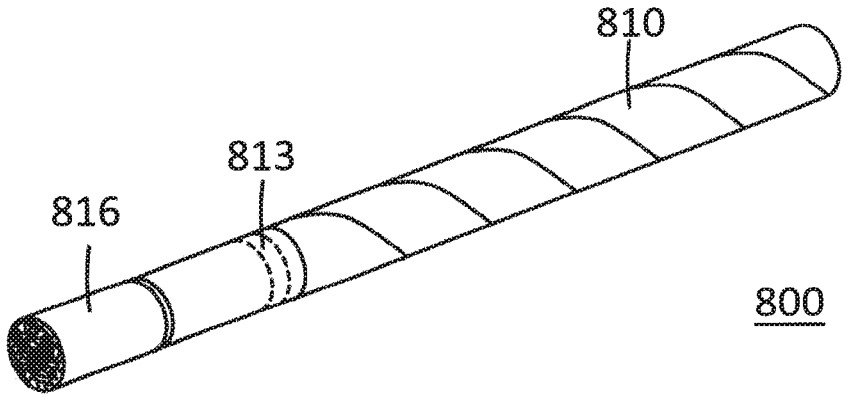

FIGS. 7*a* and 7*b* illustrate a smoking article formed as a cigar in accordance with embodiments of the present disclosure; and FIGS. 8*a* and 8*b* illustrate a smoking articled formed as a cigarillo in accordance with embodiments of the present disclosure.

DETAILED DESCRIPTION

Reference will now be made in detail to various embodiments, one or more examples of which are illustrated in each figure. Each example is provided by way of explanation and is not meant as a limitation. For example, features and/or method steps illustrated or described as part of one embodiment and/or method can be used on or in conjunction with other example embodiments and/or method steps to yield yet further example embodiments or methods. It is intended that the present disclosure includes such modifications and variations.

Example embodiments of the present disclosure are directed to a smoking article having smoking material formed from a mixture or blend including tobacco filler material and non-tobacco leaf material. The smoking article can include a smoking rod with the smoking material, or a smoking rod and a filter. The smoking article can also include an interface that may be formed from an unfilled portion of the smoking rod or the filter, that may be formed between a smoking rod and a filter, or that may be formed through other means. Additives such as tobacco derivatives or flavorants can be provided in the smoking material, the interface and/or the filter. For example, the smoking material, interface and/or filter can include additives such as one or more liquid filled capsules and/or fibrous material injected or infused with liquid additive(s) or other type of additives. The smoking article can also include a filter portion having a single- or multi-plug arrangement.

The term "mainstream smoke" includes a mixture of gases and/or aerosols passing through an example embodiment of a smoking article of the present disclosure. For example, mainstream smoke may pass from a burn end through a smoking rod, and issue from a mouth end through a filter portion opposite the burn end when a filter portion is included. Mainstream smoke may also contain air that is drawn in.

The term "sidestream smoke" includes smoke that flows directly into the air from the burn end of an example smoking article during smoking.

"Smoking" of an example embodiment of a smoking article is intended to include the heating (e.g., thermal heating), combusting and/or causing chemical reactions in the smoking material. Generally, the act of smoking a smoking article involves igniting the burn end of a smoking rod and drawing mainstream smoke through the smoking rod and out of the mouth end of the smoking article. However, smoking material may also be smoked by other means. For example, the smoking article may be smoked by heating the burn end of the smoking rod via an electrical heater, as described, for example, in commonly-assigned U.S. Pat. Nos. 6,053,176; 5,934,289; 5,591,368 or 5,322,075, each of which is incorporated herein by reference in its entirety.

The term "additive" includes any material or component which modifies the characteristics of the smoking material or the smoking article during smoking. Any appropriate additive material or combination of materials may be contained as an additive, within an additive insert, and/or inside one or more capsules, beads, or liquids to modify the characteristics of a smoking article of the present disclosure and may provide, for example, automatic or on-demand release of flavoring or other additives. Such additive materials can include flavors, neutralizing agents, and other smoke modifiers. Other examples may include, without limitation, chemical reagents like 3-aminopropylsilyl (APS) which interacts with smoke constituents. Additionally, additive materials may also include diluents, solvents or processing aids that may or may not impact the sensorial attributes of the mainstream smoke but aid in processing of an additive and its placement, encapsulation, and/or presentation in the smoking article. Additives may be provided in various forms, for example, such as liquid, beads, capsules, other solids or partially solid forms, a combination thereof, etc. As disclosed herein, additives may further include, for example and without limitation, aromas, flavorants, diluents, humectants, tobacco derivatives, or combinations thereof, and any material or component which modifies the characteristics of the smoking material or the smoking article during smoking.

According to an example embodiment of the present disclosure, the additive materials may include one or more flavors, such as liquid or solid flavors and flavor formulations or flavor-containing materials. Flavor may also include any flavor compound or tobacco extract suitable for being releasably disposed in liquid or immobilized form within an insert, beads, and/or single- or multi-part macrocapsules or microcapsules. Certain flavor additives, for example, may modify the taste of mainstream smoke produced, for example, by the smoking article. In some embodiments, an additive containing insert, bead, or capsule may be at least partially combusted or ruptured along with the combustion of the smoking rod of a smoking article during smoking to release additives from the insert, bead, and/or capsule.

Flavors or flavorings include, but are not limited to menthol, mint, such as peppermint and spearmint, chocolate, licorice, citrus and other fruit flavors, gamma octalactone, vanillin, ethyl vanillin, breath freshener flavors, spice flavors such as cinnamon, methyl salicylate, linalool, bergamot oil, geranium oil, lemon oil, ginger oil, tobacco flavor, and any other flavors. Flavors may further include flavor compounds selected from the group consisting of an acid, an alcohol, an ester, an aldehyde, a ketone, a pyrazine, combinations or blends thereof and the like. Flavor compounds may be further selected, for example, from the group consisting of phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, etc., combinations thereof and the like.

By incorporating additive materials in certain embodiments, for example, in the filler material, in inserts, or one or more beads or capsules, loss of flavor due to less tobacco in the smoking rod (compared to a smoking rod that only includes tobacco) may be reduced. In certain embodiments, additive materials in flavor capsules may be releasably disposed on-demand such that the additive materials are sufficiently contained to substantially avoid or minimize unwanted migration to other areas of the smoking article, such as during storage. Moreover, additive materials provided in capsule form may be mobile enough to be released on-demand from the flavor capsule when, for example, the capsule is broken or opened by mechanical force. For example, the flavor capsule may be broken by squeezing a portion of a filter or interface containing the flavor capsule, thus releasing the additive material stored therein.

As already discussed, additives may be implemented in a variety of physical forms including inserts, liquids, small or large beads, singular part or multipart capsules, large capsules, small capsules, microcapsules, macrocapsules, etc. In certain embodiments, flavoring, tobacco derivatives and/or other additives may be present in the smoking material of the burn portion, the mouth portion, a filter and/or an interface between the filter and smoking rod. Additives may be provided in a dispersed or densely packed arrangement. Arrangements may also be based on any one or combination of the form or size of the additive packaging (e.g., small and/or large beads or capsules), the size of the space in which the additive will be disposed, and the amount of additive desired for release during smoking.

Beads and capsules, if used, may be formed by any suitable technique including encapsulation techniques, such as spin coating, coacervation, interfacial polymerization, solvent evaporation, annular jet forming, which uses two concentric jets to eject an inner jet of liquid core material and an outer jet of liquid wall material where the fluid stream breaks into droplets and the liquid wall material solidifies by phase transition induced by the presence of cross-linking ions, pH differences, temperature changes, or other conditions as desired.

The capsules or beads may be formed as single wall or multi-wall capsules, which can be used based on capsule stability, strength, rupture resistance, processing ease in filter making, or other factor as desired, and be made of any suitable material, such as a gelatin-based material, or a polymeric material, such as modified cellulose (e.g., hydroxypropylmethyl cellulose).

Figure 1A:
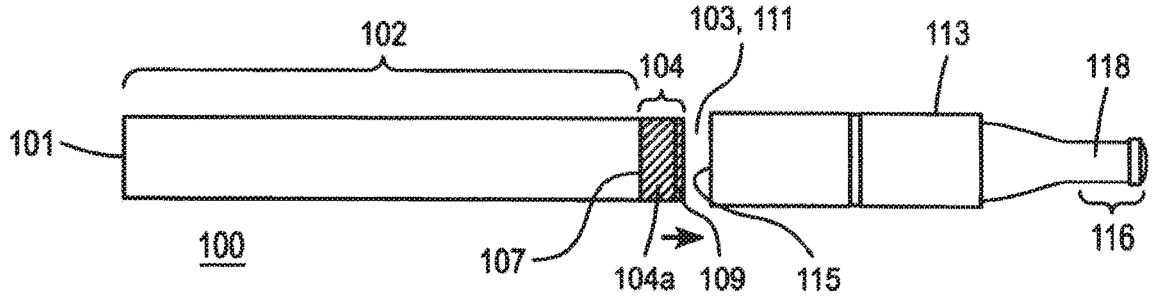
Figure 1B:
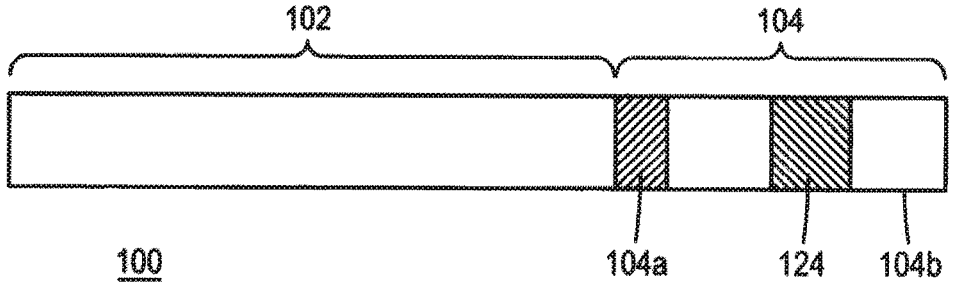
Figure 1C:
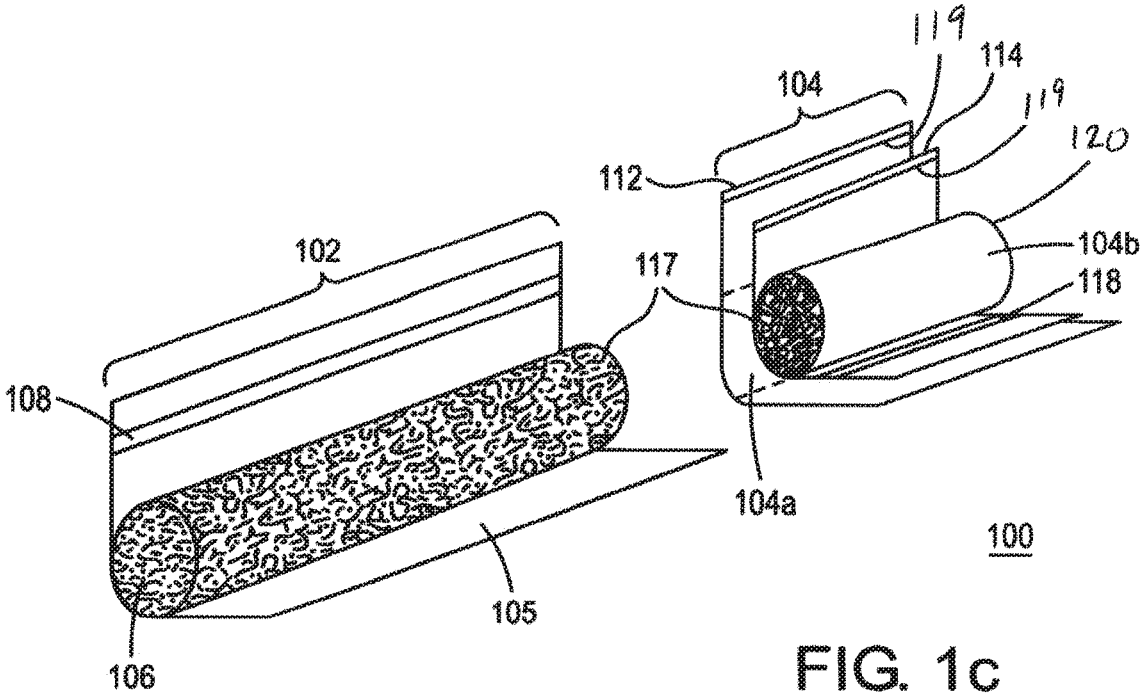

FIGS. 1*a*-1*c* illustrate smoking articles in accordance with an example embodiment of the present disclosure. The smoking article 100 may be substantially in the shape of a cylinder (other shapes may also be used). The smoking article 100 may include two sections—a burn portion 102 (e.g., smoking rod) and a mouth portion 104. An exposed end of the burn portion 102 forms a burn end 101 and an exposed end of the mouth portion 104 forms a mouth end 103. The burn portion 102 includes a smoking rod filled with smoking material 106 (FIG. 1*c*) formed from a blend or combination of non-tobacco leaf material and tobacco material. The non-tobacco leaf material may include, but is not limited to, leaves, leaf particles, leaf and other portions of plants and/or trees including but not limited to bamboo, banana, kendu, palm, coconut, fan palm, sorghum, collard green, dandelion, hawthorn, papaya, burdock, chick pea, soybean, switchgrass, timothy, sugarcane, corn, cabbage, cauliflower, tea, spinach, tomato, etc., any combination thereof, and/or any other suitable plant or leaf material as desired. Certain plant and tree leaves that may form part of the filler material in certain embodiments may have one or more properties and/or characteristics (e.g., appearance, texture, burn rate, other) that are similar to natural tobacco leaves, while certain plant and/or tree leaves that may form part of the filler material in certain embodiments may have one or more properties and/or characteristics that are dissimilar to natural tobacco leaves.

In certain embodiments, the tobacco material may be of a conventional type, which includes a naturally-allocated nicotine content, tobacco plant material, reconstituted tobacco and/or expanded tobacco, or the tobacco material may be of a modified type where the nicotine content or nicotine delivery is lower than found in conventional tobacco leaves. The modified tobacco material may be produced through known processes, which include but are not limited to nicotine extraction and tobacco plant alteration. Sample processes for extracting nicotine from tobacco leaves are described in U.S. Pat. No. 5,497,792, the content of which is hereby incorporated by reference in its entirety. Other example processes, including examples of alteration of tobacco are described in U.S. Pat. No. 9,370,160 and U.S. Patent Application Publication No. 20160374387, the entire content of each being hereby incorporated by reference. In yet another example embodiment of the present disclosure, the smoking material 106 can include a mixture of conventional tobacco material and modified tobacco material. In certain embodiments, the smoking material 106 may be formed with a filler including a mixture of any of non-tobacco leaf material, conventional tobacco material and/or modified tobacco material. The smoking material 106 used in the smoking rod may take many forms, including without limitation a pre-formed rigid rod, shredded (or cut) fibers, woven strands, filament, or any other suitable forms as desired. Prior to placement in the smoking rod, the blended smoking material 106 may include non-tobacco leaf materials that in certain embodiments may be cut or shredded into a form similar in appearance to shredded or cut tobacco. In certain embodiments the non-tobacco smoking plant materials may undergo processes and techniques similar or equivalent to those that are applied to conventional tobacco material. For example, in certain embodiments the non-tobacco leaves may undergo, any one or a combination of drying, curing, treating, fermenting, expansion, reconstitution, mixing, cutting, additive treatment, etc., or any other suitable processes as desired prior to use as smoking material 106.

As shown in FIG. 1*a*, in certain embodiments the mouth portion 104 can include an interface 104*a*. The interface 104*a* may be formed as a hollow or empty volume that may include an unfilled portion of the smoking rod 102. The interface 104*a* may be configured or arranged to store an additive. The interface 104*a* may also store tobacco cut filler material, tobacco cut filler material impregnated with an additive or in combination with an additive. According to another example embodiment, the interface 104*a* may be additive-free. In certain embodiments, the interface 104*a* is empty or there is no interface 104*a*.

In some embodiments, an interface 104*a* can be of a length suitable for storing a desired amount of additive. For example, according to an example embodiment, the interface 104*a* has a length greater than 0 mm to approximately 3 mm. Greater lengths may be used in other embodiments. The interface 104*a* may be established opposite the burn end 101 of the burn portion 102 for example through one or a combination of an unfilled portion of the burn portion 102 and an empty volume established through the portion of the wrapping paper that overlaps or extends past the opposite end 107 of the burn portion 102. While certain embodiments may include an interface 104*a*, certain embodiments do not include an interface 104*a*.

In some embodiments, a small amount (e.g., in a range of 3-5 mm by volume) of material such as cellulose acetate, polypropylene, or paper, may be used as a cap or plug 109 on the open end 111, which corresponds to the mouth end 103, of the interface 104*a* after the additive has been disposed. Material that may be disposed in the interface 104*a* may also be used to adjust a draw resistance of the smoking article as desired. A smoking tip 113 can be used in certain embodiments during smoking of the smoking article 100. For example, the end 111 of the interface 104*a* can be inserted into an open end 115 of the smoking tip 113, the open end 115 of the smoking tip 113 having a diameter suitable for receiving the smoking article. Inserting the smoking article 100 into the open end 115 of the smoking tip 113 may require a small force (e.g., minimum amount of force necessary to urge the mouth end 103 of the smoking article into the open end 115 of the smoking tip 113) in the direction (e.g., see arrow) of the open end 115 and/or rotation of the smoking article 100.

According to another example embodiment, the smoking tip 113 can be formed from any known material such as wood, plastic, composites, or any other suitable material for oral use. The smoking tip 113 can be formed using an injection molding manufacturing process. The smoking tip 113 can also have an orthonasal property whereby an additive such as flavor and/or aroma can be discharged from a surface 118 of the smoking tip 113. For example, the orthonasal property can be formed on the surface 118 in an area of the mouth end 116 as a ring, segment, patch, line or other suitable feature as desired. The orthonasal property can be integrated into the surface of the smoking tip 113 during the injection molding process or added to the surface 118 post manufacturing by known processes (e.g., patch, spray, baking, curing, etc.). The additive may include at least one of an aroma and flavor compound corresponding to (e.g., substantially the same as, substantially similar to, or complementary to) and/or simulating the aroma of the additive flavor disposed in the burn portion 102 and/or mouth portion 104 of the smoking article.

FIG. 1*b* illustrates a second smoking article in accordance with an example embodiment of the present disclosure. The smoking article 100 of FIG. 1*b* includes a burn portion 102 and a mouth portion 104. The mouth portion 104 may include an interface 104*a* and a filter plug 104*b* formed of cellulose acetate fiber or any other suitable filtering material as desired. Certain embodiments do not include an interface 104*a*.

FIG. 1*c* illustrates an exploded view of a smoking article in accordance with an example embodiment of the present disclosure. As shown in FIG. 1*c*, the mouth portion 104 may include the filter plug 104*b* that can be wrapped (e.g., covered) with tipping paper 112. A layer of plug wrap 114 can be applied on the filter plug 104*b* adjacent an inner side of the tipping paper 112. The tipping paper 112 may extend past an edge of the filter plug 104*b* and overlap the smoking rod 102 so that the mouth portion 104 and smoking rod 102 are held together. Tipping paper 112 may be of such length that an interface 104*a* of the mouth portion 104 may be established via an empty volume between the adjacent ends 117 of the burn portion 102 and the filter plug 104*b*. Extending the wrapping material 105 that wraps the smoking rod would create a similar overlapping arrangement and interface in other embodiments. In certain embodiments, interface 104*a* may be configured to store additives or other materials, as described above for FIG. 1*a*. In other embodiments, interface 104*a* may be empty as also described above. In yet other embodiments there is no interface 104*a* or space between ends 117 of the burn portion 102 and the filter plug 104*b* such that the ends of each are adjacent to each other. The end 120 of the filter plug 104*b* forms the mouth end 103 of the smoking article 100. Both the tipping paper 112 and the plug wrap 114 can have adhesive seams 119 for holding the seams of the tipping paper 112 and the plug wrap 114 together. Additional adhesive seams or lines may be included for the tipping paper 112 or the plug wrap 114. For example, the plug wrap 114 may also include an inner adhesive line 118 for adhering to the filter plug 104*b*.

The mouth portion 104 of the smoking article 100 may include any of the variety of fibrous material suitable for use as filter elements in a tobacco cigarette. The fibrous material can include cellulose acetate, polypropylene, paper, or any other suitable material as desired. The same types of fibrous materials may also be used in combination with tobacco or modified tobacco as part of the smoking rod mixture. The mouth portion 104 can include one or more fibrous material plugs. In a configuration having two or more plugs, a void or hollow space can be formed between adjacent plugs.

The conventional (e.g., natural, expanded, reconstituted, etc.) tobacco material, non-tobacco leaf material, and/or modified tobacco material may be combined or blended in a variety of ways. For example, the ratio of tobacco filler material (conventional and/or modified) to non-tobacco leaf material may be, for example and without limitation, in a range of approximately 99:1 to 1:99, including, for example, in a ratio of approximately 25:75, 75:25, 50:50, etc. Other ranges may be used. If conventional tobacco material, non-tobacco leaf material, and modified tobacco materials are combined, than a ratio may be, for example and without limitation, 30:30:40, 50:30:20, 20:40:40, 33.3:33.3:33.3, etc. In the following examples, it should be understood that the tobacco particles can be formed of conventional or modified tobacco filler material or a mixture of the two. For example, the smoking material 106 may be mixed such that the tobacco filler material and the non-tobacco leaf material can be mixed such that different filler particles are evenly and/or randomly distributed throughout the smoking material. The non-tobacco leaf material may also be substituted with modified tobacco material or a mixture of non-tobacco leaf material and modified tobacco material. In short, any combination of one or more of conventional tobacco material, non-tobacco leaf material and/or modified tobacco material may be used, and any ratios may be used.

Various filter constructions known in tobacco cigarettes similarly can be used in connection with certain embodiments of smoking articles of the present disclosure, including those in which one or more flavor capsules or other additives may be incorporated. According to other embodiments, the filter constructions may be additive-free. Example filter structures can include, but are not limited to, a mono filter, a dual filter, a triple filter, a single or multi cavity filter, a recessed filter, a free-flow filter, combinations thereof, or any other suitable filter structure or configuration as desired. Mono (e.g., single) filters can include cellulose acetate tow or cellulose paper materials. Dual filters can include a cellulose acetate mouth end and a pure cellulose or cellulose acetate segment. The length and pressure drop of the segments in a dual filter may be adjusted to maintain acceptable draw resistance. Triple filters may include mouth side and non-tobacco smoking material as side segments, and a middle segment comprising paper. Cavity filters may include at least two segments, e.g., acetate-acetate, acetate-paper or paper-paper, separated by at least one cavity. Recessed filters include an open cavity on the smoking end. The filters can also be disposed in a mechanically rotatable filter portion where flavor is released based on the pressure applied to the filter during rotation.

According to an exemplary embodiment of the present disclosure, the filter wrap 114 and/or tipping paper 112 can have an orthonasal property or characteristic 124 (e.g., FIG. 1*b*). For example, the tipping paper 112 may be processed with an additive so that a flavor and/or an aroma or scent emanates from the surface of the tipping paper 112. The tipping paper 112 and/or filter wrap 114 can include additives that discharge at least one of an aroma and flavor compound corresponding to (e.g., substantially the same as, substantially similar to, or complementary to) and/or simulating the aroma of the additive flavor disposed in the burn portion 102 and/or mouth portion 104 of the smoking article. The orthonasal property 124 may be formed wholly or partially in the filter wrap 114, the tipping paper 112, or both. According to an exemplary embodiment of the present disclosure, the orthonasal property 124 can be formed on the filter wrap 114 and/or tipping paper 112 as a ring, segment, patch, line, or other suitable feature as desired.

Figure 2A:
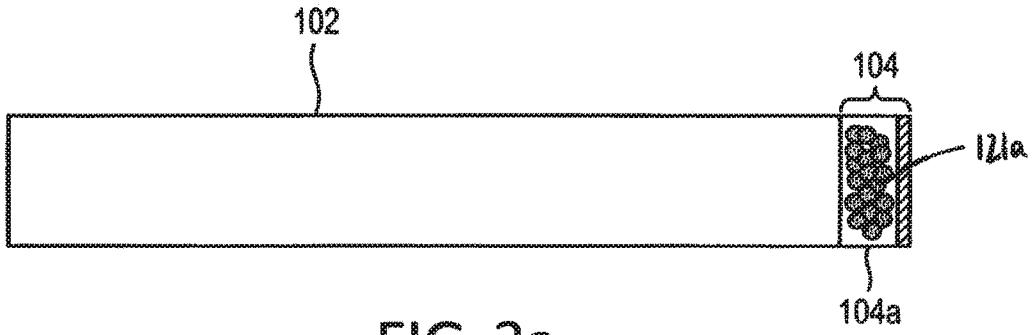
Figure 2B:
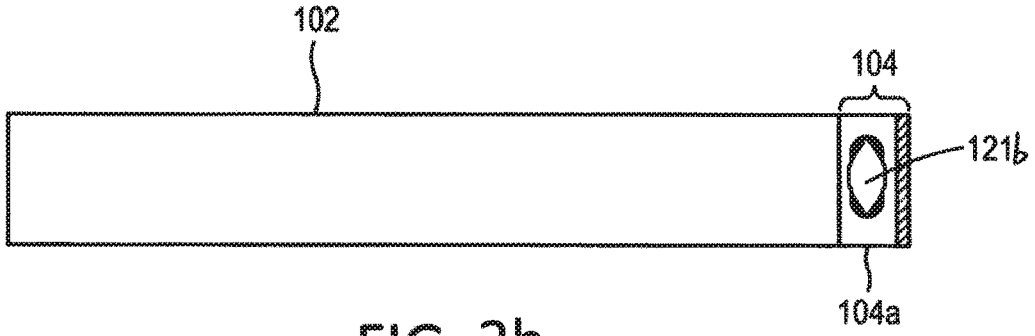
Figure 2C:
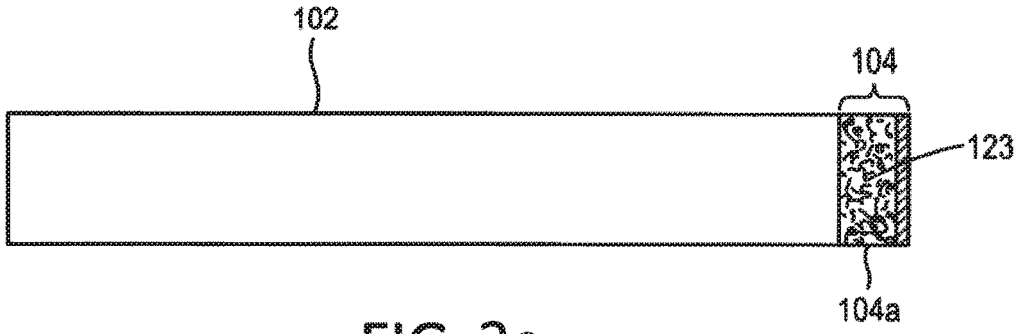

FIGS. 2*a*-2*c* illustrate an interface of a smoking article storing an additive in accordance with an exemplary embodiment of the present disclosure. FIG. 2*a* illustrates an interface 104*a* storing a plurality of flavor and/or other additive beads or capsules 121*a*. FIG. 2*b* shows an interface 104*a* storing a single bead or capsule 121*b*. FIG. 2*c* illustrates an interface 104*a* filled with material 123, such as tobacco material, non-tobacco leaf material, cellulose acetate, polypropylene, or paper, or other suitable material as desired, and which may be impregnated with a liquid additive. Interfaces 104*a* such as those shown in FIGS. 2*a* to 2*c* may be used in embodiments such as those in FIGS. 1*b* and 1*c*, as well as in embodiments such as those in FIG. 1*a*.

The smoking material 106 can be processed to include additives including any combination of flavorants, or diluents including propylene glycol, glycerine, water, ethanol, tobacco derivatives, and any other additives as desired. According to an example embodiment of the present disclosure, the smoking material 106 can be impregnated with any additives, including, for example and without limitation, flavors or tobacco derivatives. The smoking material can be encased or wrapped with known wrapping material used in tobacco cigarettes. For example, the wrapping material 105 can include paper having an adhesive 108 (FIG. 1*c*) for holding the seams of the wrapping material together.

According to another example embodiment, the smoking material 106 can be used in an additive-free state. Additives, if used, can also be present in an interface 104*a* or a filter, for embodiments with a filter or interface. For example, in certain embodiments, the interface 104*a* may be filled at least partially with cellulose acetate, polypropylene, or paper material, and said materials may be impregnated with a liquid additive.

Figure 3:
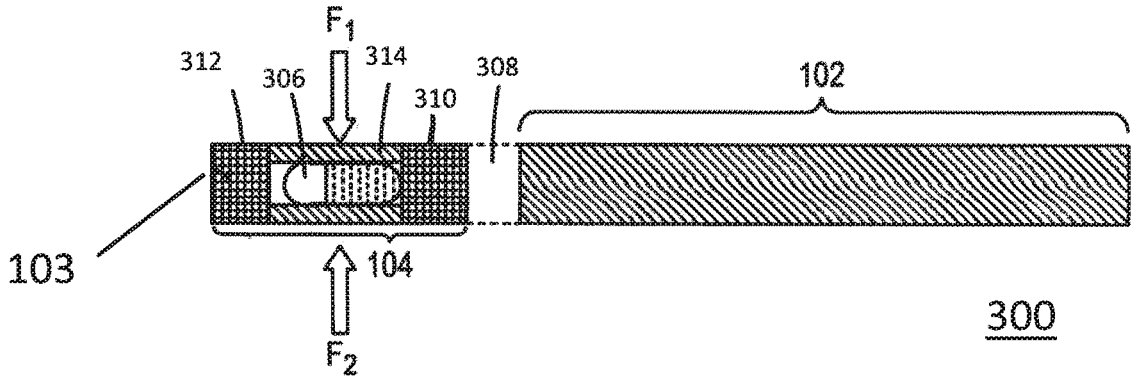
FIG. 3 illustrates a cross-sectional view of a smoking article having an interface and a flavor capsule in the filter portion in accordance with an embodiment of the present disclosure.

FIG. 3 illustrates a cross-sectional view of a smoking article having a capsule in the filter portion in accordance with an example embodiment of the present disclosure. As shown in FIG. 3, the smoking article 300 includes a mouth portion 104 having a flavor capsule 306 including additive material, such as flavorant. The mouth portion 104 can be attached to the burn portion 102 where the mouth portion 104 may include a filter having a multi-plug design. For example, the mouth portion 104 may include along a length of the smoking article, an interface 308, which may store a liquid additive impregnated within or coated on material such as cellulose acetate, polypropylene, or paper. The interface 308 may be adjacent the burn portion 102. Certain embodiments include filter plugs 310, 312. According to another exemplary embodiment, an additive in the form of a one or plural beads or capsules may be stored. The additive bead or capsule 306 can be located between the filter material regions 310, 312. The additive bead or capsule 306 can be frictionally fitted in a hollow acetate tube 314. An additive, such as an additive bead or capsule 306 can also or alternatively be located in interface 308.

For on-demand release of the additive, an area of the mouth portion 104 can be squeezed with forces $F_1$, $F_2$ on either side of the additive capsule 306. The applied forces may cause at least partial rupture of the bead or capsule 306, and/or other method to thereby release the additive component to saturate or impregnate the filter plugs 310, 312. As the smoking article 300 is smoked, the additive released by the additive capsule 306 can be exposed to mainstream smoke passing through the mouth portion 104.

Figure 4:
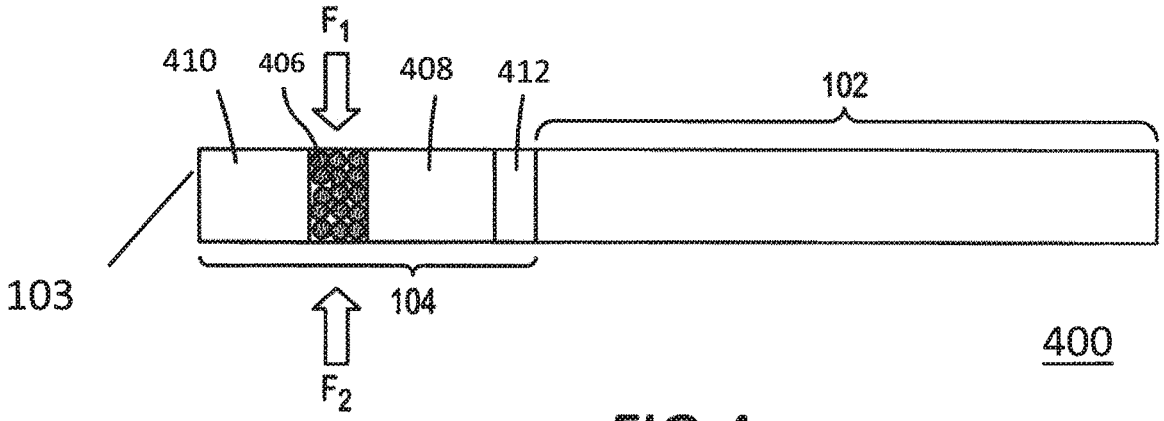
FIG. 4 illustrates a cross-sectional view of a smoking article having an interface and a plurality of flavor microcapsules in the filter portion in accordance with an embodiment of the present disclosure.

FIG. 4 illustrates a cross-sectional view of a smoking article having microcapsules in the filter portion in accordance with an example embodiment of the present disclosure. As shown in FIG. 4, the smoking article 400 can include a burn portion 102 and mouth portion 104. The mouth portion 104 can have a multi-plug filter design that includes filter plugs 408 and 410 where filter plug 408 is adjacent the burn portion 102 and filter plug 410 is on the mouth end 103. The filter portion 104 can include flavor capsules 406 in the form of one or more microcapsules which encapsulate additive(s), such as flavorant. Each microcapsule 406 may be used alone or in combination with other microcapsules 406. When used in a smoking article 400, each microcapsule can contain the same or different additives from other microcapsule(s) in the smoking article 400, where applicable, depending upon the desired additive(s) or flavor. The smoking article 400 can also include an interface 412 for releasably storing a liquid additive impregnated in a material, such as cellulose acetate, polypropylene, or paper, or an additive provided in one or more beads or capsules. The additive provided in the interface 412 can be used in combination with or as a substitute for like additives provide in the smoking material 106 of the burn portion 102.

Figure 5:
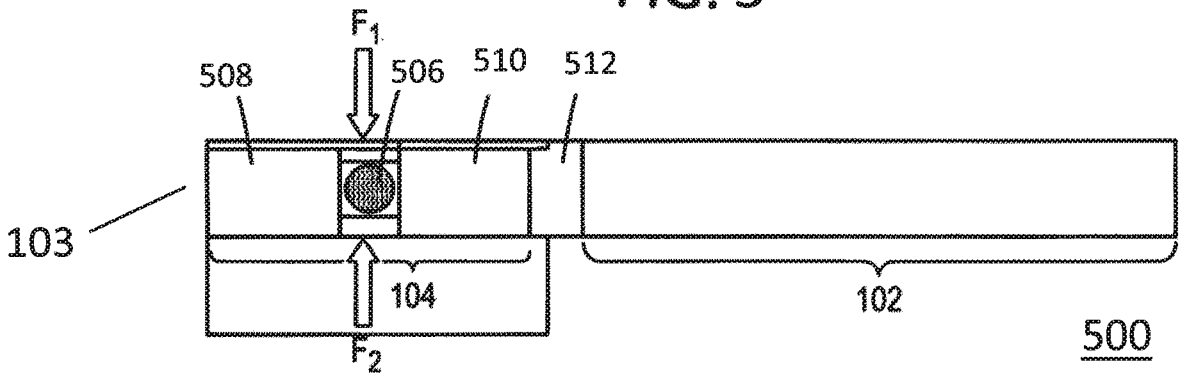
FIG. 5 illustrates a cross-sectional view of a smoking article having an interface and a flavor macrocapsule in the filter portion in accordance with an embodiment of the present disclosure.

FIG. 5 illustrates a cross-sectional view of a smoking article having one or more macrocapsules in the form of additive spheres 506 in the mouth portion in accordance with an example embodiment of the present disclosure. As illustrated in FIG. 5, in certain embodiments the macrocapsule 506 may be located downstream from filter plug 510.

On-demand release of the additives from the microcapsules 406 of FIG. 4 or macrocapsules 506 of FIG. 5 may be achieved by squeezing with force on either (e.g., one or both) side(s) of the mouth portion 104 that contains the microcapsules 406 or macrocapsules 506, respectively. By applying the force ($F_1$, $F_2$), one or more of the microcapsules 406, 506 can be ruptured and the additive(s) contained therein would be released into the filter of the mouth portion 104 of the smoking article 400, 500. Thus, the additive(s) can be released within the mouth portion 104 after force is applied, providing on-demand delivery of flavorant.

As discussed in U.S. Pat. No. 7,578,298, the content of which is hereby incorporated by reference in its entirety, use of flavor capsules may provide advantages for supplying an additive component to the smoking article. Migration of the additive may be minimized in certain embodiments due to the use of a capsule which can retain the additive in a primary reservoir or within the microcapsules until use. The flavor capsules in certain embodiments provide a protective structure to prevent or minimize the migration of the additive component during storage into other parts of the smoking material. Locating flavor capsules in the filter in some embodiments may minimize loss of flavor to side stream smoke.

The additive which may be released from the additive capsules or beads upon squeezing or applying external force thereto may be supplied in any amount desirable for the particular type of additive used. The amount may be determined by the specific design of the additive capsules or beads, for example the first part of a two-part capsule may serve as the primary reservoir for the additive component, or the number and size of the microcapsules present in the filter. The amount of additive used per smoking article can be small since the additive is substantially sealed in the capsules during packaging and storing of the smoking article. An appropriate and/or desired amount of additive, e.g., such as flavor, can be released into the smoking article via the capsules. For example, when the capsules can release the additive in a small range, e.g., 3-6, 6-9, 9-12 microliters, or large range, e.g., 6-9, 9-12, or 12-15 or more microliters. In certain embodiments, the amount of additive released during smoking in the smoking article may be based on the number and/or size of capsules pre-loaded, a force applied to release the additive, and/or a number of sequentially applied forces.

Additive capsules may be of any size suitable for use in a smoking article. Additive capsules can have a diameter that is less than the diameter of the smoking article, e.g., less than 2 mm, 2 to 3 mm, 3 to 4 mm, 4 to 5 mm or greater than 5 mm, and can vary in length depending on the length of a filter in the mouth portion 104, e.g., less than 8 mm, 8-10 mm, 10-12 mm, or more than 12 mm. The additive capsule of FIG. 3 can be of sufficient size in certain embodiments, e.g., about 2 to 4 mm in diameter and about 8-11 mm in length, to allow for a desired amount of liquid additive component to be held within a multi-part capsule while the multi-part capsule also fits into the filter and provides a conveniently-sized target to apply force.

A two-part capsule can be placed in a hollow tube, by way of example, a hollow acetate tube, having an external diameter similar to that of a cigarette filter. In certain embodiments the placement of the capsule may be such that there is filter material at both ends of the hollow tube as shown in FIG. 3 or the hollow tube containing the capsule may be placed at a mouth end 103 of the mouth portion 104. Additionally, the orientation of the two-part capsule may be such that the portions of the capsule where force is applied are located within the axial circumference of a filter within the mouth portion 104, while the direction of the additive release may be oriented toward the mouth end of the mouth portion 104 or the burn portion 102 end of the mouth portion 104. It is noted that the orientation allows for access to applying force to the portions of the capsule designed to release additives upon the application of force.

In order to provide one or more microcapsules and/or macrocapsules in a mouth portion 104 of the smoking article in accordance with an example embodiment, the capsules can be the same or different sizes. For example, microcapsules can be made with rounded shapes having diameters smaller than 0.3 mm, from 0.3 to 1.0 mm, or even bigger diameters. According to an example embodiment the microcapsules can be provided with diameters of about 0.3 to 0.4 mm. According to another example embodiment, the microcapsules can be provided in the form of round capsules with diameters of about 0.3 to about 0.4 mm or larger. In accordance with an exemplary embodiment of the present disclosure, macrocapsules can have rounded shapes, with diameters of 1.0 to 6.0 mm. Diameters may also be smaller or larger. According to another exemplary embodiment, the macrocapsules can have a diameter from 3.0 to 4.0 mm. Round microcapsules and macrocapsules with these size ranges may allow for the effect on the resistance to draw by the microcapsules and/or macrocapsules to be minimal and may be compensated for in certain embodiments by a smoking article having a loosely packed or reduced packing tightness of smoking material in the burn portion 102 or the filter components (e.g., filter plugs) of the mouth portion 104.

Microcapsules having a diameter of about 0.35 mm packed in a hollow tube with a diameter of about 8 mm may allow in some embodiments the hollow tube to achieve about 90% fill without a substantial change in the resistance to draw. It is also noted that microcapsules smaller or larger than 0.35 mm diameter capsules may be used. In certain embodiments, smaller microcapsules may be dispersed in filter tow material in the filter, rather than in a cavity, as the smaller size may lead to tighter packing and may lead to an increase in the resistance to draw if packed in a hollow tube portion of a filter. Larger microcapsules may also be dispersed in a filter tow material rather than in a cavity.

As illustrated in FIG. 4, microcapsules 506 (or macrocapsule 506 in FIG. 5) can be provided through a portion of the depth, width and length of mouth portion 104. The microcapsules 406, similar to the placement for the two-part capsule, can then be placed in a hollow tube such as a hollow acetate tube establishing an external diameter of the filter portion 104.

Figure 6:
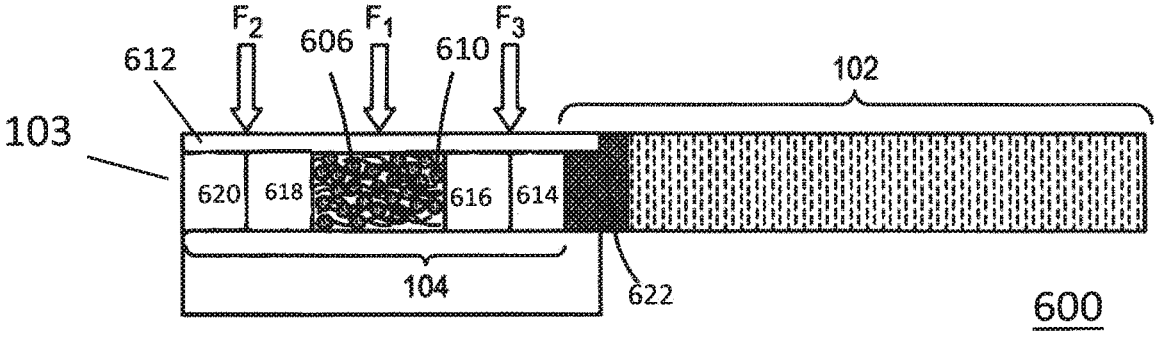
FIG. 6 illustrates a cross-sectional view of a smoking article having an interface and flavor microcapsules embedded in filter material in the filter portion in accordance with an embodiment of the present disclosure.

FIG. 6 illustrates a cross-sectional view of a smoking article having beads embedded in filter material in the filter portion in accordance with an example embodiment of the present disclosure. In accordance with yet another example embodiment of the present disclosure, microcapsules 606 can also be within a filter plug 610 of the mouth portion 104. The filter plug 610 can comprise the entirety of the filter, or can be sandwiched between one or more filter plugs on each side, such as filter plugs 614, 616 on a burn portion 102 end of the mouth portion 104 and filter plugs 618, 620 on a mouth end 103 of the mouth portion 104. The smoking article 600 can also include an interface 622 storing a liquid additive along with cellulose acetate tow. The additive or additives in the interface 622 may be used a substitute or in combination with additives that may be provided in the smoking material provided of the burn portion 102 and/or with additives that may be provided in an interface between the burn portion and the filter. In certain embodiments, additives may be released automatically during the smoking. In some embodiments, forces ($F_1$, $F_2$, $F_3$) may be applied along the length of the hollow acetate tube 612 of the filter portion 104 for on-demand release of the flavor additive into the smoking article 600. For example, if a force is applied in the area of $F_1$, the additives may be released proportional to the applied force in the directions of filter plugs 614, 616 and 618, 620. If a force is applied in the area of $F_2$, the additives may be released in a direction toward filter plugs 614, 616. If a force is applied in the area of $F_3$, the additive may be released in a direction toward filter plugs 618, 620. Thus, according to an exemplary embodiment of the present disclosure, on-demand release, direction and/or amount of a flavoring in filter plug 610 may be controlled at least to some extent based on the location or area along the mouth portion 104 at which a force ($F_1$, $F_2$, $F_3$) is applied.

According to an exemplary embodiment of the present disclosure, the smoking article can include a deodorant that is releasably stored as an additive in the filter portion 104. In certain embodiments the deodorant can be releasably stored in a crushable bead or capsule of a hollow tube as described in accordance with FIGS. 3-6. The deodorant can be in liquid or powder form and include a base or acidic material, or a combination thereof (e.g., baking soda), which when released can disintegrate and modify odors and/or aromas. In certain embodiments, deodorants may also be released automatically during smoking, or on-demand by applying a force F to the capsule or bead as shown in FIGS. 3-6. In certain embodiments, when a deodorant is present in the mouth portion 104, flavor and/or other additives could be releasably stored in different locations, such as for example, the interface and/or the burn portions.

FIGS. 7*a* and 7*b* illustrate a smoking article formed as a cigar in accordance with an exemplary embodiment of the present disclosure. As shown in FIGS. 7*a* and 7*b*, the smoking article 700 can be in the form of a cigar having a smoking material 702, a binder 704, and a wrapper 706. According to an example embodiment, the smoking material 702 can include non-tobacco leaf material. According to an example embodiment, the smoking material 702 can be a blended material formed as a combination of non-tobacco leaf material and tobacco material as shown and described in relation to the smoking rod of FIG. 1. The tobacco material can be formed from one of conventional tobacco material, modified tobacco material, or a combination thereof as desired. The smoking material 702 can be impregnated with one or more additives (e.g., flavour, diluent, humectant, tobacco derivatives, etc.), as already discussed. The wrapper 706 can be formed of any casing materials, such as a material including tobacco material according to some embodiments, and/or material including non-tobacco leaf material. According to yet another example embodiment, an additive insert can be inserted into the smoking material 702 of the cigar 700, such that when heated to at least a partially degraded state, the insert releases the additives into the smoking material 702.

FIGS. 8*a* and 8*b* illustrate a smoking article formed as a cigarillo in accordance with an exemplary embodiment of the present disclosure. As shown in FIGS. 8*a* and 8*b*, the smoking article can be formed as a cigarillo 800 and include a burn portion (e.g., smoking rod) 802 and a mouth portion 804. The burn portion 802 may be filled with a smoking material 806 that includes non-tobacco leaf material and/or a blend of non-tobacco leaf material and tobacco material as shown and described in relation to the smoking rod of FIG. 1. The tobacco material can be formed from one of conventional tobacco material, modified tobacco material, or a combination thereof as desired. The smoking material 806 can be impregnated with one or more additives (e.g., flavour, diluent, humectant, tobacco derivatives, etc.), as already discussed. The burn portion 802 can be covered with an inner binder 808 and may also include an outer wrapper 810. The mouth portion 804 can include a filter plug 812 formed of cellulose acetate tow, use other filter designs as described above, or may include the same or similar materials as the burn portion 802. The mouth portion 804 may also include an interface 813, similar to other interfaces described herein, while other embodiments will not include an interface 813. The filter plug 812 can be wrapped with plug paper 814. Tipping paper 816 may also be wrapped around the filter plug 812 on an outer surface of the plug paper 814. The tipping paper 816 can include suitable adhesive portions (not shown) at the seams so that when wrapped around the filter plug 812 the tipping paper overlaps on one end such that can securely attach the filter portion 904 to the burn portion 802. In certain embodiments, a space that may be established between adjacent ends of the filter plug 812 and the burn portion 802 to form an interface 813. The filter plug 812, interface 813 and/or the smoking material 806 may be impregnated with additives, such as a liquid or house one or more beads or capsules as described herein.

According to yet another exemplary embodiment of the present disclosure, a method of making smoking articles includes depositing a blended smoking material including a combination of non-tobacco leaf material and tobacco material. As already discussed, the tobacco material can be formed from one of conventional tobacco material, modified tobacco material, or a combination thereof as desired. The non-tobacco leaf material may include, but is not limited to, leaves, leaf particles, leaf and other portions of plants and/or trees including, but not limited to, bamboo, banana, kendu, palm, coconut, fan palm, sorghum, collard green, dandelion, hawthorn, papaya, burdock, chick pea, soybean, switchgrass, timothy, sugarcane, corn, cabbage, cauliflower, tea, spinach, tomato, etc., any combination thereof, and/or any other suitable plant or leaf material as desired. The non-tobacco leaf material, natural tobacco material, modified tobacco material, or a combination thereof may be treated with an additive, cut and/or shredded and deposited in a machine to form the smoking material blend. Further steps in the production of exemplary smoking articles as described herein include placing a paper wrapper around the blended material to form a burn portion (e.g., smoking rod). In certain embodiments, a filter portion may be attached to the burn portion, and in some embodiments a space may be formed between the two parts. The space may be empty or may be used as an interface within which additives can be stored and released during smoking. In other embodiments, a filter portion may be attached to the burn portion such that no space is formed between the two parts. An additive may also be added to the smoking material, which may, for example, consist of a liquid, bead, capsule, etc. The filter may be configured to have one more filter plugs, wherein the one or more filter plugs or a space between adjacent plugs may be filled with additives, such as flavor capsules, liquids, beads, etc. The filter may be configured to have other filter designs for smoking articles. Tipping paper may be wrapped around the mouth portion and may overlap the smoking rod. The tipping paper may be formed (e.g., processed) having a property or characteristic whereby an aroma or scent emanates from the tipping paper.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A smoking article, comprising:
- a smoking rod including,
  - a filler material including,
    - tobacco material, and
    - non-tobacco leaf material excluding papaya,
    - the filler material being distributed along a length of the smoking rod,
    - the non-tobacco leaf material including leaves, leaf particles, leaf portions, or any combination thereof of one or more non-tobacco plants, trees, or both plants and trees,
    - the one or more non-tobacco plants, trees, or both plants and trees consisting of bamboo, banana, kendu, palm, coconut, fan palm, sorghum, collard green, dandelion, hawthorn, burdock, chick pea, soybean, switchgrass, timothy, sugarcane, cabbage, cauliflower, spinach, tomato, or any combination thereof, and
    - a ratio of an amount of the tobacco material in the smoking rod to an amount of the non-tobacco leaf material in the smoking rod is in a range of 95:5 to 55:45;
- wrapping paper around the filler material along the length of the smoking rod; and
- an interface at a portion of the smoking rod that is not filled with the filler material nor an additive, the interface being empty and having a length greater than 0 millimeter to less than or equal to about 3 millimeters, the interface being at least partially defined by an inner surface of the wrapping paper and a mouth end of the tobacco filler material.

2. The smoking article of claim 1, wherein the filler material includes an additive.

3. The smoking article of claim 2, wherein the additive includes a flavorant.

4. The smoking article of claim 2, wherein the additive includes a tobacco derivative.

5. The smoking article of claim 1, wherein the non-tobacco leaf material includes an additive.

6. The smoking article of claim 1, wherein the tobacco material includes conventional tobacco material, modified tobacco material, or both.

7. The smoking article of claim 1, wherein the non-tobacco leaf material is impregnated with an additive.

8. The smoking article of claim 7, wherein the additive includes a flavorant.

9. The smoking article of claim 1, wherein the tobacco material or the non-tobacco leaf material, or both, are impregnated with an additive.

10. The smoking article of claim 1, wherein the tobacco material includes modified tobacco material.

11. The smoking article of claim 1, further comprising:
- a filter portion.

12. The smoking article of claim 11, wherein the filter portion includes a single plug or multi-plug arrangement.

13. The smoking article of claim 11, wherein the filter portion includes an additive releasably stored in a bead or a capsule, or both.

14. The smoking article of claim 11, wherein the interface is between the filter portion and the filler material.

15. The smoking article of claim 1, wherein the interface is opposite to a burn end of the smoking rod.

16. The smoking article of claim 11, wherein the filter portion includes a plug-space arrangement.

17. The smoking article of claim 1, being formed as one of a cigarette, a cigar, or a cigarillo.

18. A smoking article, comprising:
- a smoking rod including,
  - a filler material including,
    - modified tobacco material, and
    - non-tobacco leaf material,
    - the filler material being distributed along a length of the smoking rod,
    - the non-tobacco leaf material including leaves, leaf particles, leaf portions, or any combination thereof of one or more non-tobacco plants, trees, or both plants and trees,
    - the one or more non-tobacco plants, trees, or both plants and trees consisting of bamboo, banana, kendu, palm, coconut, fan palm, sorghum, collard green, dandelion, hawthorn, burdock, chick pea, soybean, switchgrass, timothy, sugarcane, cabbage, cauliflower, spinach, tomato, or any combination thereof, and
    - a ratio of an amount of the modified tobacco material in the smoking rod to an amount of the non-tobacco leaf material in the smoking rod is in a range of 95:5 to 55:45;
- wrapping paper around the filler material along the length of the smoking rod; and
- an interface at a portion of the smoking rod that is not filled with the filler material nor an additive, the interface being empty and having a length greater than 0 millimeter to less than or equal to about 3 millimeters, the interface being at least partially defined by an inner surface of the wrapping paper and a mouth end of the tobacco filler material.

19. The smoking article of claim 1, wherein a ratio of the amount of tobacco material in the smoking rod to the amount of the non-tobacco leaf material is 75:25.

20. The smoking article of claim 1, wherein the interface is completely defined by the inner surface of the wrapping paper, the mouth end of the tobacco filler material, and a cap or plug on a mouth end of the wrapping paper.

* * * * *